US006007157A

United States Patent [19]

Stewart

[11] Patent Number: 6,007,157

[45] Date of Patent: Dec. 28, 1999

[54] SLIDABLY DISPLACEABLE DUCT ASSEMBLY FOR A MINING MACHINE

[75] Inventor: Christopher G. Stewart, Oil City, Pa.

[73] Assignee: Joy MM Delaware, Inc., Wilmington, Del.

[21] Appl. No.: 09/067,185

[22] Filed: Apr. 27, 1998

[51] Int. Cl.[6] ..... E21C 41/00; E21C 31/10

[52] U.S. Cl. ..... 299/10; 299/12; 299/64

[58] Field of Search ..... 299/10, 12, 64; 55/356, 357, 385.5

[56] References Cited

U.S. PATENT DOCUMENTS

| | | | |
|---|---|---|---|
| 3,387,889 | 6/1968 | Ziemba et al. . | |
| 3,712,678 | 1/1973 | Amoroso . | |
| 3,743,356 | 7/1973 | Sheets . | |
| 4,157,878 | 6/1979 | Jamison | 405/303 |
| 4,200,036 | 4/1980 | Matta et al. | 454/171 |
| 5,487,766 | 1/1996 | Vannier | 55/356 |
| 5,597,393 | 1/1997 | Johnson et al. . | |

*Primary Examiner*—David Bagnell
*Assistant Examiner*—John Kreck
*Attorney, Agent, or Firm*—Thomas J. Edgington

[57] ABSTRACT

An apparatus for filtering airborne contaminates that has a frame member and a collection duct attached thereto. A duct assembly is slidably supported on the frame member and selectively movable along a linear path between a first position adjacent the frame member and collection duct and a second position displaced from the frame member. A fan for inducing airflow into the collection duct and duct assembly may be attached to the duct assembly for travel therewith or attached to the frame and the duct assembly when the duct assembly is in the first position. The duct assembly may be selectively movable between the first and second positions along a linear path relative to the frame member by a slidable support attached between the frame member and duct assembly.

13 Claims, 11 Drawing Sheets

SLIDABLY DISPLACEABLE DUCT ASSEMBLY FOR A MINING MACHINE

CROSS-REFERENCE TO RELATED APPLICATIONS

Not applicable.

FEDERALLY SPONSORED RESEARCH

Not applicable.

BACKGROUND OF THE INVENTION

1. Field of the Invention

The present invention relates to dust filtering and collection apparatuses and, more particularly, is directed to dust collection apparatus for collecting and filtering dust created by a mining machine.

2. Description of the Invention Backgound

Over the years, many different methods and apparatuses have been developed to extract coal and other valuable materials from beneath the earth's surface. Today, a variety of automated equipment exists for mining such materials at great subterranean depths.

One type of coal mining apparatus comprises a mobile mining machine that has a rotatable cutting or mining head that is equipped with a plurality of cutting bits adapted to dislodge the coal from the seam. The cutting head is typically attached to a movable boom arrangement that enables the position of the cutting head to be adjusted relative to the mine floor. As the cutting head is rotated and advanced into the seam, the coal is dislodged from the mine face and is received on gathering and conveying apparatuses mounted to the mining machine. The conveying apparatus discharges the mined coal onto separate freestanding or mobile conveying apparatus for eventual transfer out of the mine.

As the cutting bits engage the coal, fine particles of dust are created which, if not controlled, tend to permeate the air around the mining machine. Many methods and apparatuses have been developed in an effort to control the proliferation of such dust throughout the mine. For example, temporary barriers are typically used to direct fresh air across the mine face and into an exit duct arrangement wherein the dust laden air can be filtered. In addition, various mining machine-mounted filter/duct arrangements have also been used to filter dust laden air at the mine face.

For example, U.S. Pat. No. 3,387,889 to Ziemba et al. discloses a coal dust removal and conveyance system for use in connection with a continuous mining machine that comprises a duct-like air flow chamber that is attached to the mining machine boom for travel therewith. The air flow chamber has openings therein that are adjacent to the mining machine's cutter heads to permit dust laden air to be drawn into the air flow chamber. The rear portion of the air flow chamber is attached to a filter tank by a flexible coupling member which allows the air flow member to pivotally travel with the boom. A blower is operably coupled to the filter tank for drawing the dust laden air into the air flow chamber and through the filter tank. The blower is rigidly attached to the mining machine, while the filter member can be pivotally supported on the mining machine to enable it to be selectively tilted toward and away from the blower.

Another mine dust collection apparatus for use in connection with a continuous miner is disclosed in U.S. Pat. No. 3,712,678 to Amoroso. This apparatus has a first duct housing that is mounted to the mining machine boom for travel therewith. A second duct housing is rigidly mounted to the mining machine's chassis. A third connecting duct housing overlies the adjacent ends of the first and second ducts. The connecting duct housing is pivotally mounted to the second duct housing to permit the first duct housing to pivot with the boom.

U.S. Pat. No. 3,743,356 to Sheets discloses a coal dust removal system for use with a mining machine that comprises a forward hood member that is pivotally attached to an enclosure hood that houses a filter chamber and a fan chamber. The forward hood member is pivotally attached to the enclosure hood such that it can pivotally travel with the boom of the mining machine. The enclosure hood is fixed to the main frame member of the mining machine.

The above-discussed duct arrangements and others like them comprise heavy, rigid structures that are fitted onto the mining machine to clean contaminates at the mine face. Because such ductwork is typically attached to the top of the mining machine and generally extends the entire length thereof, access to the mining machine components located under such ductwork is limited. Thus, typical ductwork arrangements often must be completely removed from the mining machine by auxiliary equipment to enable one to gain access to the components located thereunder. Such removal processes are difficult to perform in the confines of the mine and are usually very time consuming. Many unproductive hours can be wasted in the process of removing the ductwork to gain access to an otherwise readily repairable hose leak located under the ductwork.

U.S. Pat. No. 5,597,393 discloses a displaceable filtering apparatus that, in many cases, effectively addresses the above-mentioned problems. The filtering apparatus disclosed in that patent is pivotally attached to mining machine frame to enable the apparatus to be selectively pivoted to a position which exposes the components located thereunder. Unfortunately, in applications wherein the seam is rather short in height, often times there is not enough head room to accommodate the pivotally displaced duct assembly.

Accordingly, there is a need for a ductwork system for use in connection with a mining machine that can remove airborne contaminates from the mine face and can be easily maneuvered and manipulated to provide quick access to the various components of the mining machine or other vehicle to which it is attached in applications where ceiling height may be limited.

SUMMARY OF THE INVENTION

In accordance with a preferred form of the present invention, there is provided an apparatus for filtering airborne contaminates. The apparatus may comprise a frame member that has a collection duct attached thereto. In addition, a duct assembly is slidably supported on the frame member for movement between a first position adjacent the frame member and the collection duct such that the duct assembly can cooperate with the collection duct to create an air flow passage therebetween and a second position wherein the duct assembly is displaced from the frame member. A fan may also be attached to the duct assembly for travel therewith. A support is attached to the frame member and the duct assembly for slidably supporting the duct assembly relative to the frame member along a linear path between the first and second positions. The invention also includes a displacement member for selectively displacing the duct assembly between the first and second positions along the linear path.

In another embodiment of the present invention, an apparatus for collecting airborne contaminates generated by a mining head of a mining machine is disclosed. The apparatus may include at least one collection duct attached to the mining machine adjacent the mining head. A duct assembly corresponding to each collection duct and being slidably supported on the mining machine frame member for selective movement between first and second positions. When in the first position, the duct assembly is adjacent the mining machine frame member and the corresponding collection duct to cooperate therewith to form an airflow passage therebetween. When in a second position, the duct assembly is displaced from the mining machine frame. The apparatus may also include a fan that corresponds and is attached to each duct assembly for selectively causing contaminate-laden air to be drawn into the corresponding duct assembly and pass therethrough. The apparatus also comprises a support that corresponds to each duct assembly for attaching the duct assembly to the mining machine such that the support slidably supports the corresponding duct assembly between the first and second positions along a linear path relative to the mining machine frame. A displacement member, corresponding to each support is attached to the mining machine and corresponding duct assembly for selectively slidably displacing the corresponding duct assembly between the first and second positions. This apparatus also includes a filter that corresponds to and is attached to each duct assembly for filtering the contaminate-laden air drawn therethrough.

Another embodiment of the present invention comprises apparatus for collecting airborne contaminates generated by a mining head of a mining machine having a top portion. The apparatus includes a collection duct that is attached to the mining machine adjacent the mining head. A duct assembly is removably connected to the collection duct for creating an air flow passage and is supported on the top portion of the mining machine. A filter assembly is mounted within the duct assembly to filter contaminates from an air flow passing through the duct assembly. A fan is attached to the duct assembly for inducing an airflow therein. The apparatus also includes a support that is attached to the mining machine and the duct assembly. The support defines a linear track for slidably supporting the duct assembly relative to the mining machine between a first position wherein the duct assembly is attached to the collection duct and a second position spaced-apart from the top portion of the mining machine. A hydraulic cylinder is attached to the mining machine and the duct assembly for selectively moving the duct assembly between the first and second positions. A cradle is attached to the mining machine for supporting the fan when the duct assembly is in the first position.

Another embodiment of the present invention comprises a mining machine that includes a frame member that has tractive members attached thereto for propelling the frame member on a surface. A mining assembly is operably attached to the frame member and is constructed to dislodge a material from a seam when it is brought into contact therewith. A collection duct is attached to the frame member adjacent the mining assembly for collecting airborne contaminates generated when the mining assembly contacts the seam. A duct assembly is removably attachable to the collection duct when the duct assembly is adjacent to the frame member in a first position. A filter is mounted to the duct assembly for filtering airborne contaminates passing therethrough. The mining machine also includes a fan attached to the duct assembly for travel therewith. A first support member is attached to the frame member and the duct assembly and defines a linear track for slidably supporting the duct assembly between the first position and a second position wherein the duct assembly is spaced apart from the frame member. A displacement member is attached to the frame member and the duct assembly for selectively displacing the duct assembly between the first and second positions. A second support member may also be attached to the frame member for supporting the fan when the duct assembly is in the first position.

The subject invention also comprises a method for filtering airborne dust created by a mining machine during mining. The method may include attaching a collection duct to the mining machine for collecting said airborne dust therein. The method may also include slidably supporting a duct assembly that includes a filter and a fan on a frame of the mining machine for slidable travel along a linear path between a first position adjacent the mining machine frame and the collection duct and a second position wherein the duct assembly is spaced apart from the mining machine frame. The method may also include attaching an end of the duct assembly to the collection duct and activating the fan to cause the airborne dust to pass through the collection duct and filter.

It is a feature of the present invention to provide a displaceable apparatus for filtering airborne contaminants that can be selectively displaced between a first filtering position and a second maintenance position adjacent to the structure to which it is attached.

It is a feature of the present invention to provide a duct assembly for use in connection with a mobile vehicle such as a mining machine which can remove airborne contaminates and can be easily maneuvered relative to the mining machine to provide access to the components thereof.

It is a further feature of the present invention to provide an apparatus with the above-mentioned attributes that can be effectively utilized to gain access to mining machine components located under the duct assembly or other equipment in applications having limited overhead clearance.

Accordingly, the present invention provides solutions to the aforementioned problems commonly encountered with dust filtering apparatus used in connection with mining machines. The reader will appreciate that these and other details, objects and advantages will become apparent as the following detailed description of the present preferred embodiment thereof proceeds.

BRIEF DESCRIPTION OF THE DRAWINGS

In the accompanying drawings, there is shown a present preferred embodiment of the invention wherein like reference numerals are employed to designate like parts and wherein.

DETAILED DESCRIPTION OF THE PREFERRED EMBODIMENTS

Figure 1:
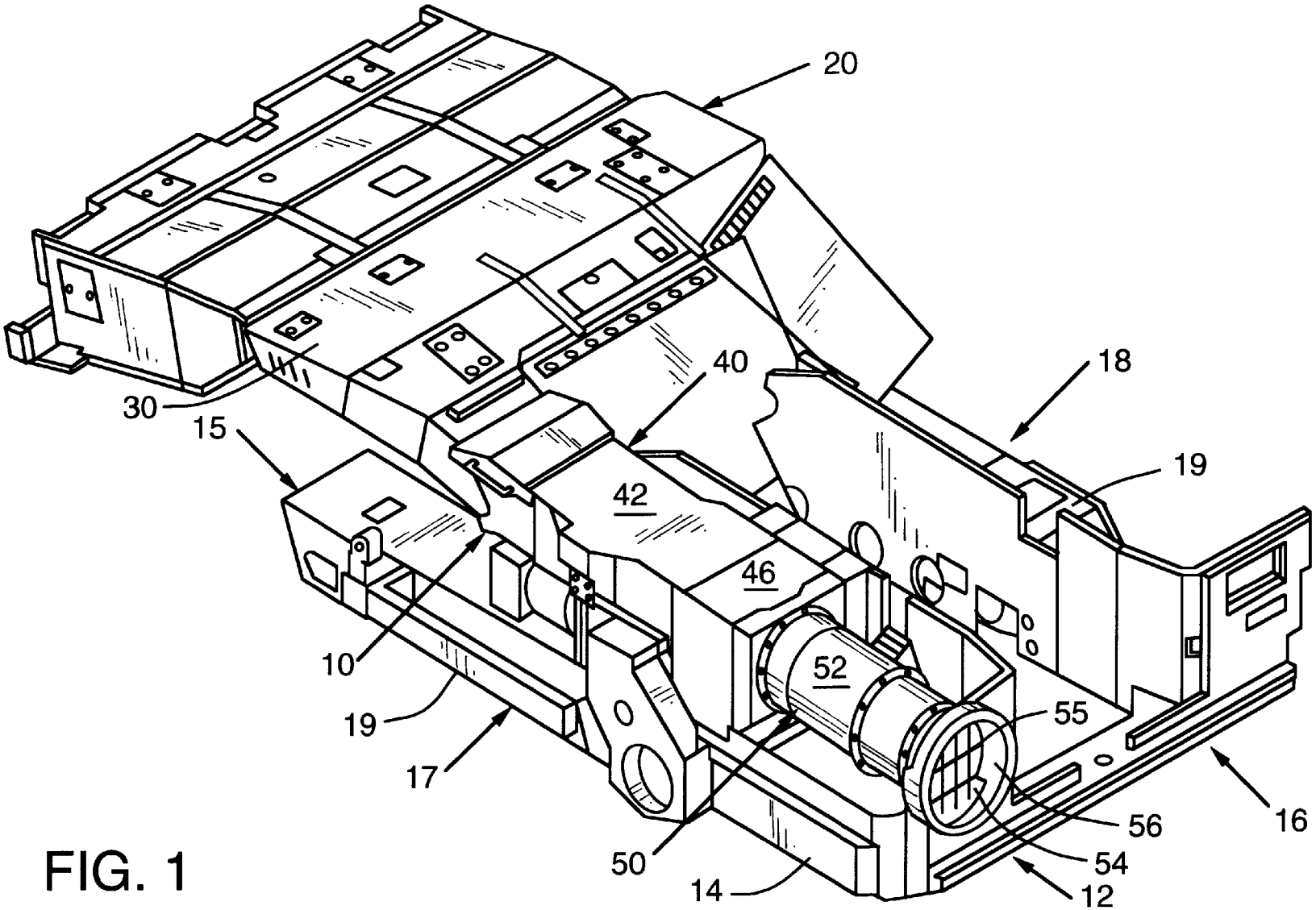
FIG. 1 is a rear perspective view of a displaceable duct assembly apparatus of the present invention attached to a mining machine and being located in a first operating position, with the mining head thereof omitted.
Figure 2:
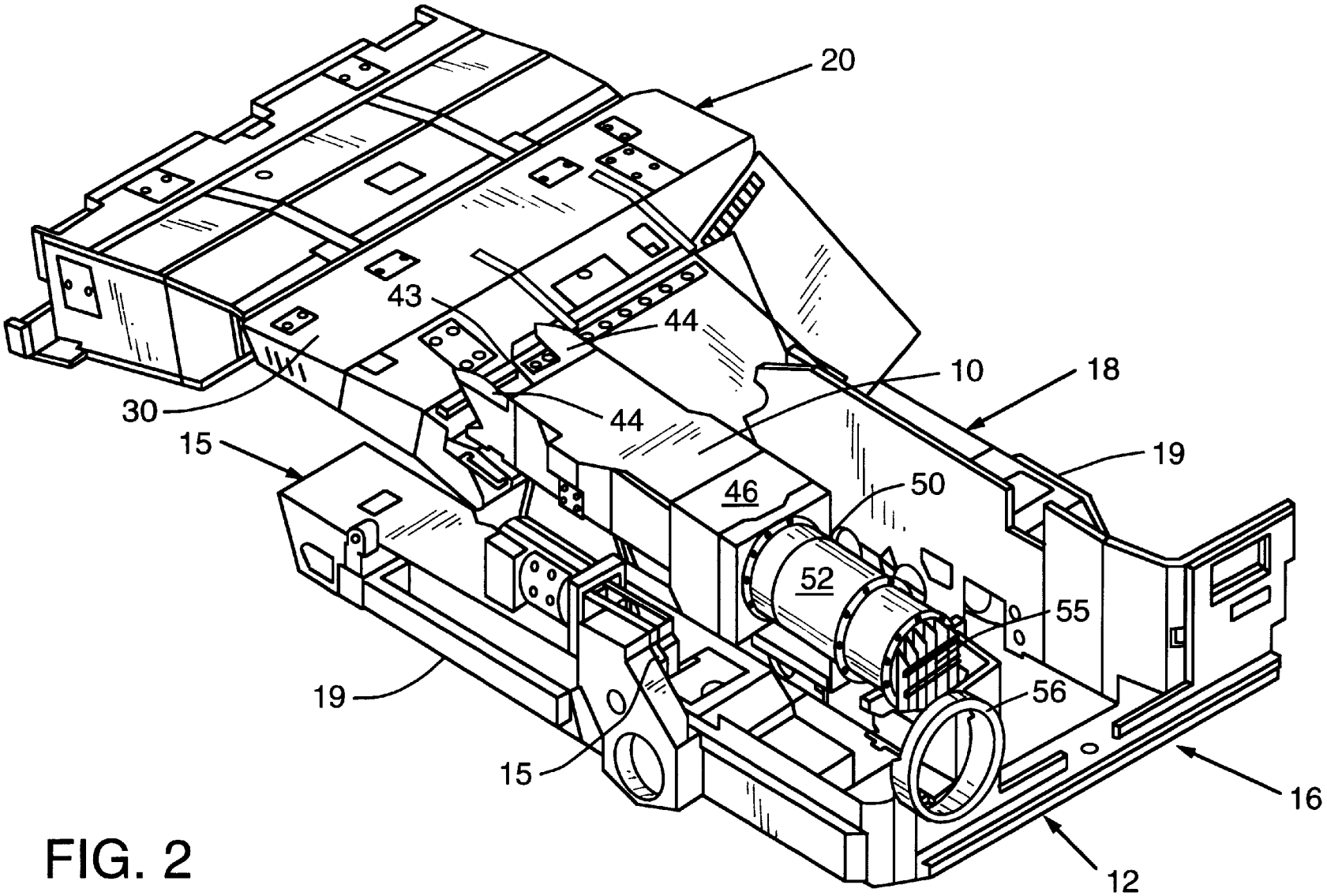
FIG. 2 is another rear perspective view of the mining machine of FIG. 1 with the displaceable duct assembly thereof in a second position spaced-apart from the mining machine frame.

Referring now to the drawings for the purposes of illustrating the present preferred embodiment of the invention only and not for purposes of limiting the same, the Figures show displaceable filtering apparatus for collecting airborne contaminates generally designated as 10. The various embodiments of the subject invention described herein are particularly well-adapted for use in connection with a mobile mining machine for collecting airborne dust particles generated thereby during the mining of coal and similar materials. However, the reader will readily appreciate that the subject invention could also be successfully used in connection with a variety of other vehicles/apparatuses wherein access to components typically located under filtering/collection apparatus may be required from time to time. Thus, while the subject invention is herein described in connection with a mobile mining machine, the scope of protection afforded to the subject invention should not be limited solely to that application.

More particularly and with reference to FIG. 1, there is shown a collection apparatus 10 operably attached to a mining machine 12. The mining machine 12 may comprise a frame member 14 that has a front portion 15, a rear portion 16, a right lateral side 17 and a left lateral side 18. A pair of tractive assemblies, preferably in the form of two endless driven tracks 19, are operably attached to the mining machine 12 for propelling the mining machine 12 along a mine surface. A movable boom member 20 is pivotally attached to the frame member 14 and is selectively pivotable by hydraulically powered cylinders (not shown). The boom member 20 operably supports a conventional mining head 22 that may comprise a series of rotatable cutting drums 24 that have a plurality of conventional mining bits 26 attached thereto. See FIGS. 3 and 4. As the mining bits 26 engage the material to be mined, dust is typically generated in the vicinity of the mining head 22.

In a preferred form, the collection apparatus 10 of the present invention comprises a collection duct 30, a duct assembly 40 and an exhaust fan 50 assembly, all adapted to be serially interconnected to form a continuous air flow passage generally designated as 60. Preferably, collection duct 30 and duct assembly 40 are fabricated from steel or sheet metal material using known fabricating methods. However, other materials could be successfully used.

The collection duct 30 is affixed to the boom 20 for travel therewith and has at least one opening therein (not shown) to permit contaminate-laden (i.e., dust-laden) air to be drawn therein. Collection duct 30 also has a discharge end 36 that is oriented to communicate with the duct assembly 40 when the duct assembly 40 is in a first or "down" position. See FIGS. 1 and 3. In addition, a cover 39 is pivotally attached to the collection duct 30 adjacent the discharge end 36 for pivotal travel as indicated by arrow "A" and is a sized to overlay a portion of the duct assembly 40 when it is aligned with the discharge end of the collection duct.

The duct assembly 40 may comprise an elongated forward duct 42 that has a front portion 43 that has forwardly extending side walls 44 configured to cooperate with the rear portion of the collection duct and to receive cover 39 thereon to form an airflow passage 45 between the collection duct 30 and the forward duct 42. See FIG. 3. If desired, one or more side walls 44 may be pivotally attached to the remaining portion of the forward duct 42. In a preferred embodiment, a conventional filter unit 46, of the type commonly used in the mining industry, may be attached to the forward duct 42. For example, filter unit 46 may comprise a commercially available fluid "scrubber" the use of which is well-known in the mining industry. However, other filter arrangements that utilize metal mesh or fibrous mesh filter screens, etc. may also be used.

To induce airflow through the continuous passage 60, an exhaust fan 50 is attached to the end of the filter unit 46. It will be appreciated that the exhaust fan 50 may be powered by the mining machine 12 in a known manner and serves to induce contaminate-laden air to be drawn into the collection duct 30 through the openings therein and flow through the continuous air flow passage 60. Fan 50 preferably has a cylindrical housing 52 that facilitates attachment of the fan 50 in serial alignment with the filter unit 46 and forward duct 42 such that fan 50 travels with the forward duct assembly 42 when it is slidably displaced away from the frame 14 as will be discussed in further detail below. The skilled artisan will readily appreciate, however, that other fan arrangements and mounting methods may also be used.

Figure 3:
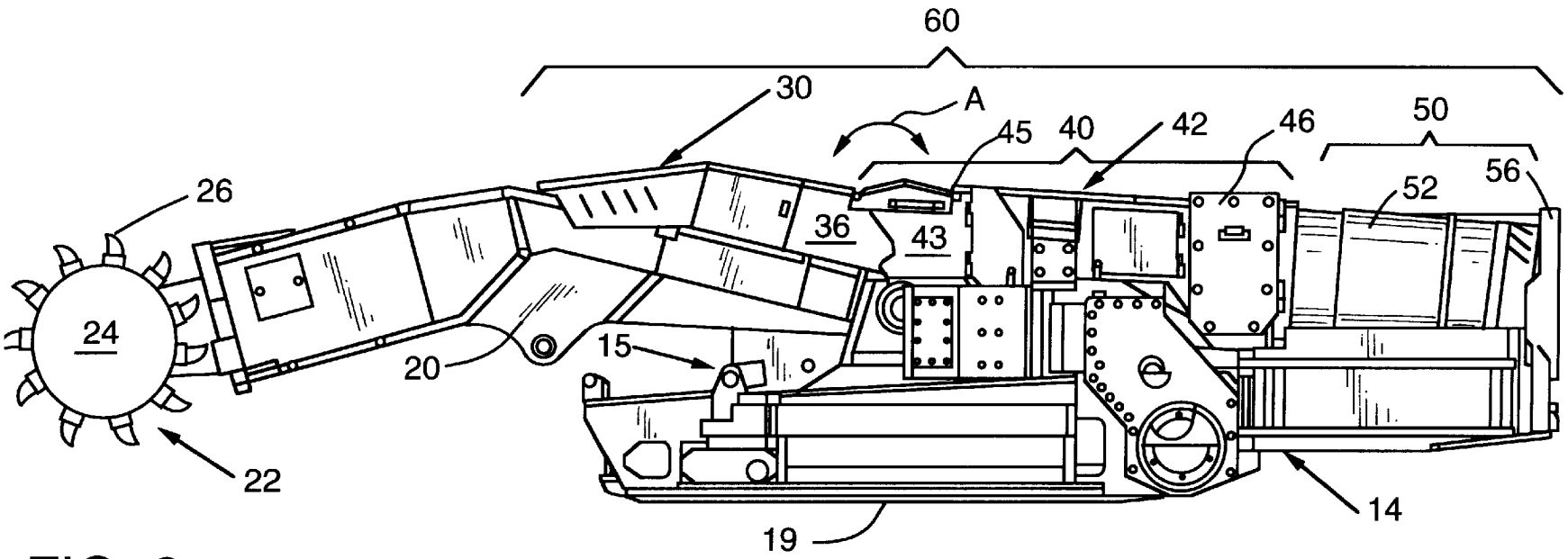
FIG. 3 is a side elevational view of the mining machine of FIG. 1, with the mining head thereof shown.
Figure 4:
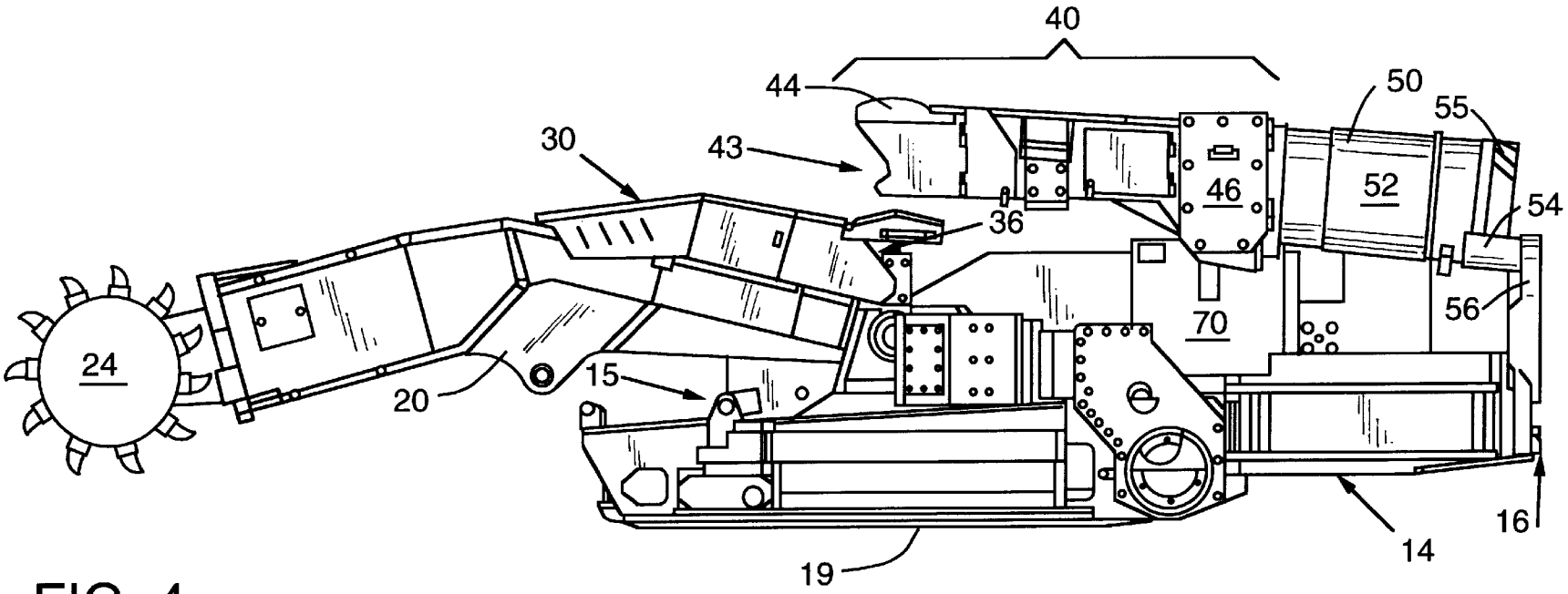
FIG. 4 is a side elevational view of the mining machine of FIG. 2, with the mining head thereof shown.

To provide support to the fan housing 52 when the duct assembly is in a first down position as shown in FIGS. 1 and 3, a cradle ring 56 is attached to the frame 14 in the manner shown in FIGS. 1–4. As can be seen in FIGS. 3 and 4, the lower end of housing 52 is provided with a mounting protrusion 54 that is adapted to be received on the cradle ring 56 when the duct assembly 40 is in the first position. See FIGS. 1 and 3. Those of ordinary skill in the art will appreciate that the cradle ring 56 serves to provide lateral support to the fan housing 52 and the duct assembly 40 when in the first position. As can also be seen in FIGS. 1–4, fan 50 is preferably provided with a safety screen or grate 55 to prevent objects and/or personnel from inadvertently contacting the fan during operation.

Figure 5:
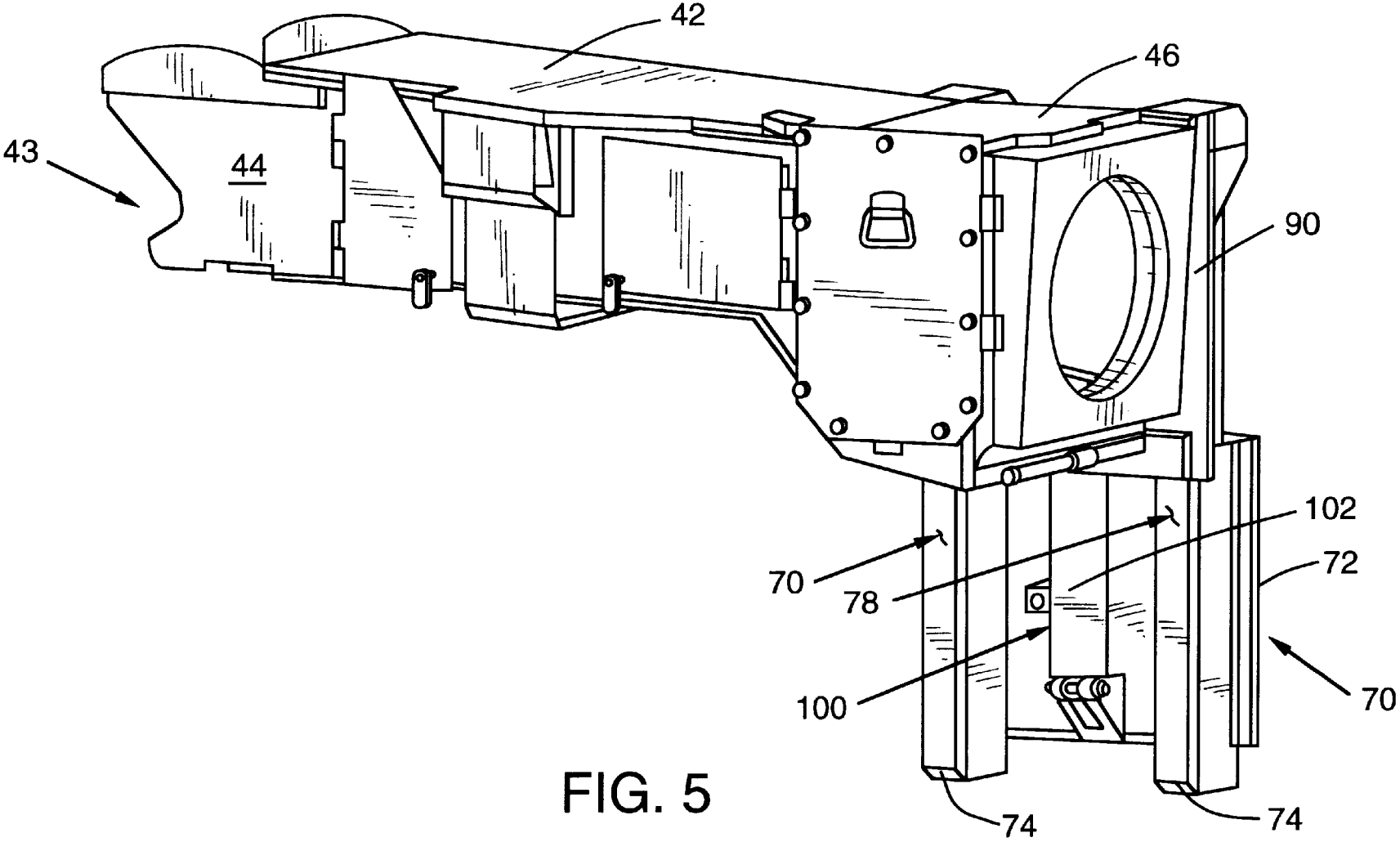
FIG. 5 is a partial rear perspective view of a duct assembly of the present invention attached to a slidable support member of the present invention, with the duct assembly being moved to the second extended position and the fan omitted for clarity.
Figure 6:
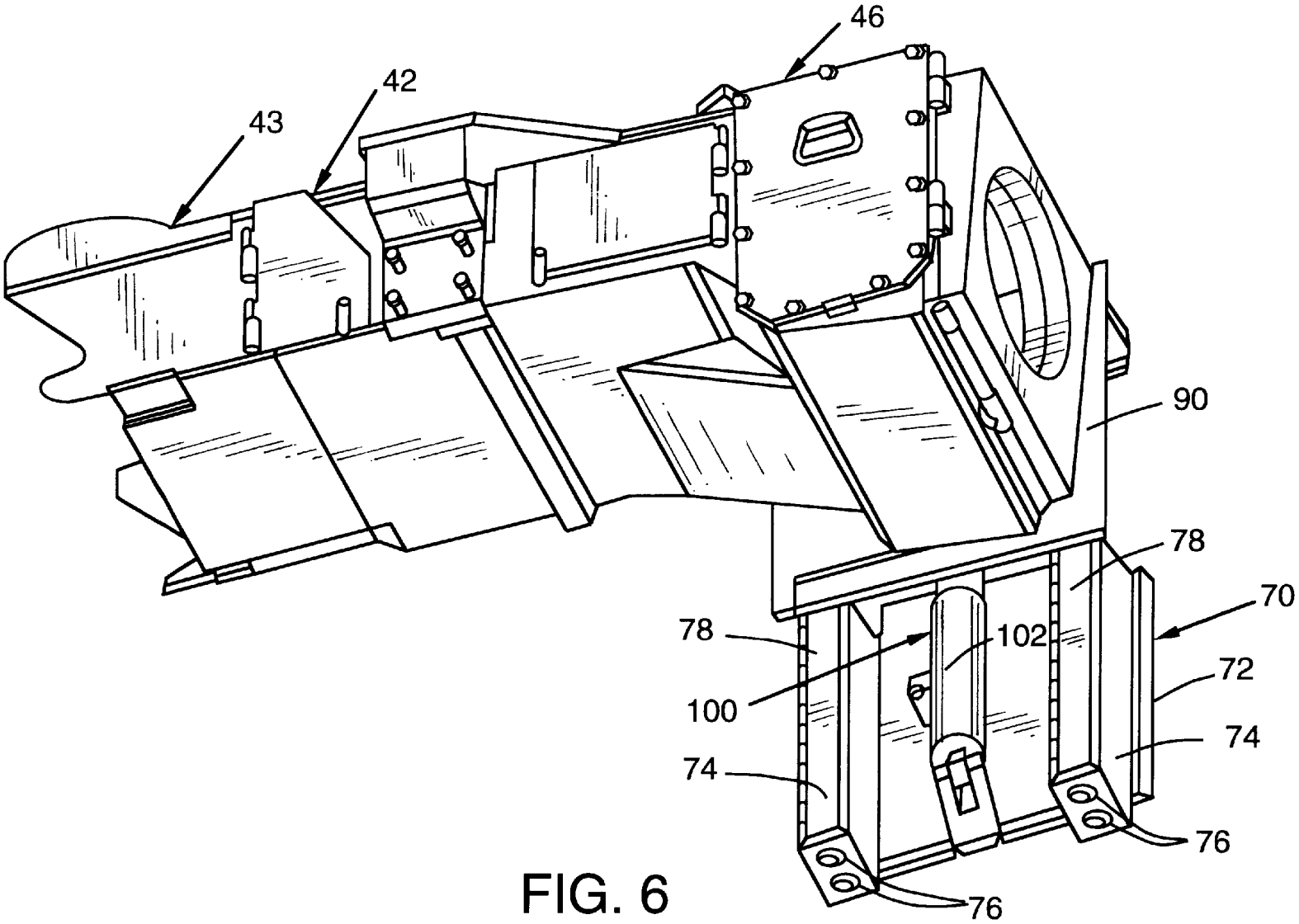
FIG. 6 is bottom perspective view of the duct assembly and slidable support member depicted in FIG. 5.

As can be seen in the Figures, the duct assembly 40 is slidably supported relative to the mining machine frame member 14 by a slidable support assembly 70. More particularly and with reference to FIGS. 5–9, support assembly 70 preferably comprises a first mounting plate 72 that facilitates ready attachment of the slidable support assembly 70 to the frame member 14 by, for example, welding or bolting. Attached to the mounting plate 72 in a spaced-apart relationship as shown in FIGS. 5 and 6 are slide rails 74 that each preferably have two elongated passages 76 provided therethrough. In addition, each slide rail 74 has a slide surface 78 machined thereon that is adapted to slidably engage a corresponding second mounting plate 90 affixed to the duct assembly 40. Preferably, slide surfaces 78 are provided with a machined finish. However, other tolerances and finishes could also be successfully employed.

The duct assembly 40 is preferably slidably affixed to the slide rails 74 by four support rods 92 that are attached to the support plate 90 that is attached to the duct assembly 40 and are slidably received in a corresponding passage 76 in the slide rails 74. See FIG. 7. Support rods 92 may be fabricated from polished stainless steel and are adapted to slide within their corresponding passage. To facilitate a slidable interface between a passage 76 and a corresponding slide rod 92, a commercially available bushing or bearing 94 may be fitted into the passage 76 to receive the slide rod 92 therein. The skilled artisan will appreciate that such slidable support arrangement serves to define a linear pathway (represented by arrow "B") along which the duct assembly 40 may be slidably displaced relative to the frame member 14.

Figure 7:
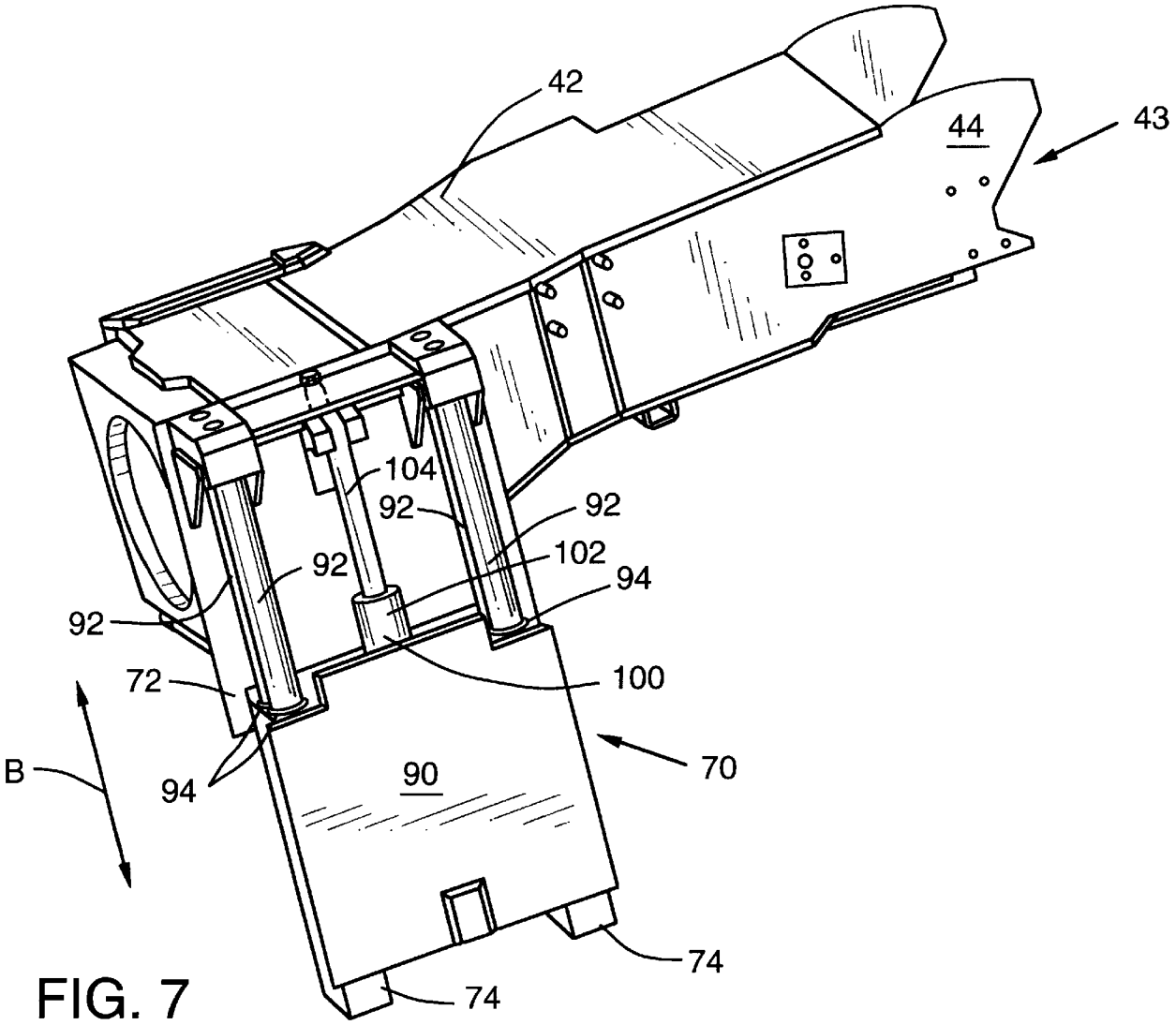
FIG. 7 is another bottom perspective view of the duct assembly and slidable support member depicted in FIGS. 5 and 6.

To selectively displace the duct assembly 40 from a first position wherein the duct assembly 40 is adjacent the top of the frame member 14 (FIGS. 1, 3, and 9) to a second position (FIGS. 2 and 4–8) wherein the duct assembly 40 is displaced apart from the frame member 14 to expose, for example, components 15 normally located under the duct assembly 40 when in the first position, a displacement member, in the form of, for example, at least one commercially available hydraulically powered cylinder 100 is attached between the first and second support plates (72, 90) as shown in FIGS. 5 and 7. Hydraulic cylinder 100 is connected to the mining machine's hydraulic system and its operation and control is well-known in the art. The cylinder 100 has a housing 102 that slidably supports an extendable piston 104 therein. Housing 102 may be attached to the second support plate 90 and the end of piston 104 may be attached to the first support plate 72 such that when the piston 104 is slidably extended from the housing 102 by admitting a pressurized fluid therein, the duct assembly 40 is moved from the first position to the second position. Likewise, when the piston 104 is withdrawn into the housing 102, the duct assembly 40 is slidably moved back to the first position.

Figure 10:
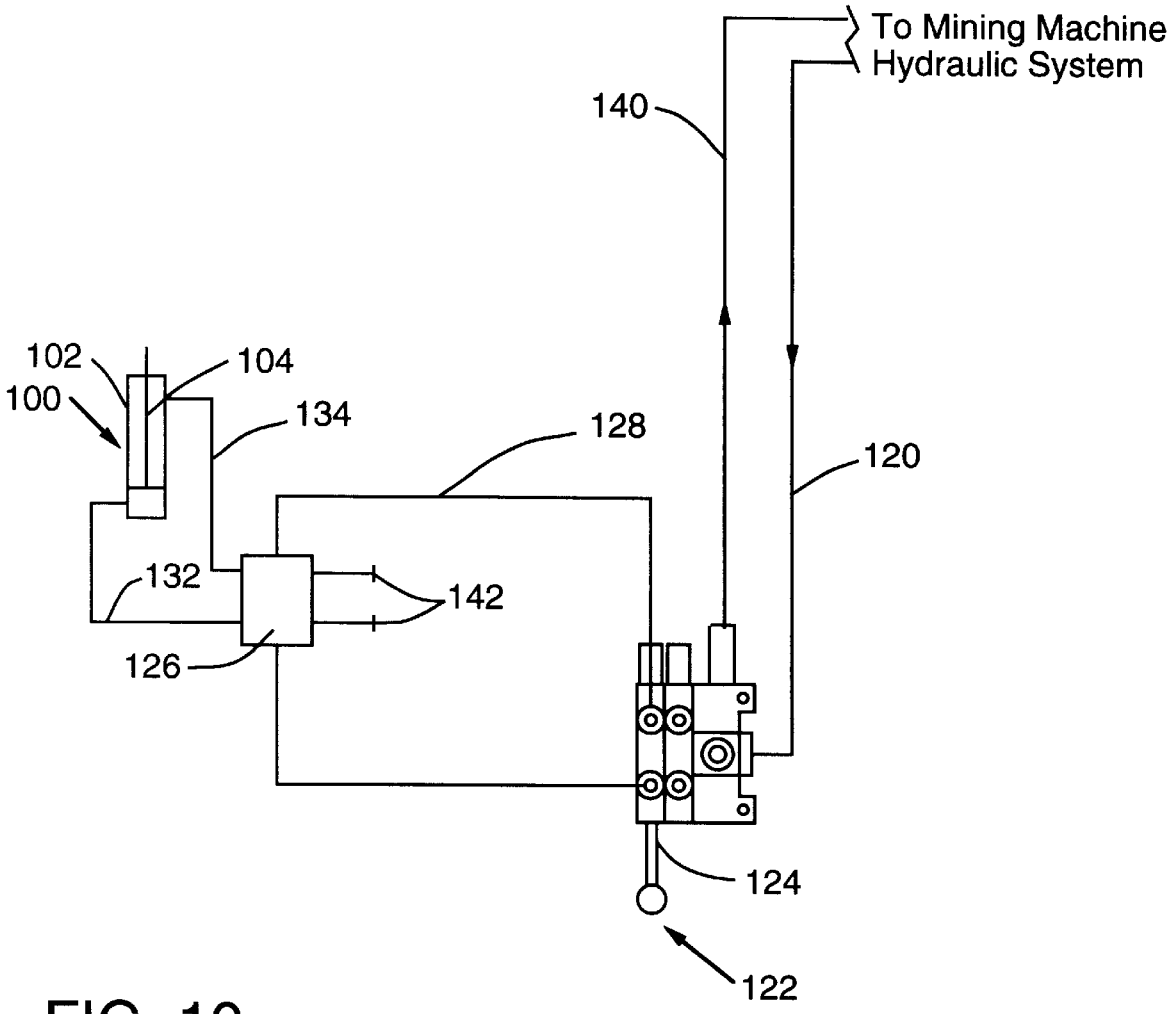
FIG. 10 is a schematic of a preferred hydraulic system for controlling the displacement cylinder of the present invention.

FIG. 10 is a schematic of a preferred hydraulic system for controlling the hydraulic cylinder 100. As can be seen in FIG. 10, a supply line 120 is attached to the mining machine's hydraulic supply tank and pumping system (not shown). The supply line 120 supplies hydraulic fluid under pressure to valve assembly 122. Valve assembly 122 comprises a commercially available diverter valve and includes manually operable valve 124 that is attached to pilot check valve 126 by lines 128 and 130. Pilot check valve 126 is attached to the cylinder 100 by lines 132 and 134. Line 132 supplies hydraulic fluid under pressure to the cylinder 100 for causing the piston 104 to be extended. Line 134 supplies hydraulic fluid under pressure to cylinder 100 to cause the piston 104 to be retracted. Line 140 is a return line for returning hydraulic fluid to the mining machine's main hydraulic fluid tank. In addition, ports 142 may be provided in the system to accommodate the use of a hand pressure pump to extend the cylinder 100 in the event of hydraulic system failure.

Figure 8:
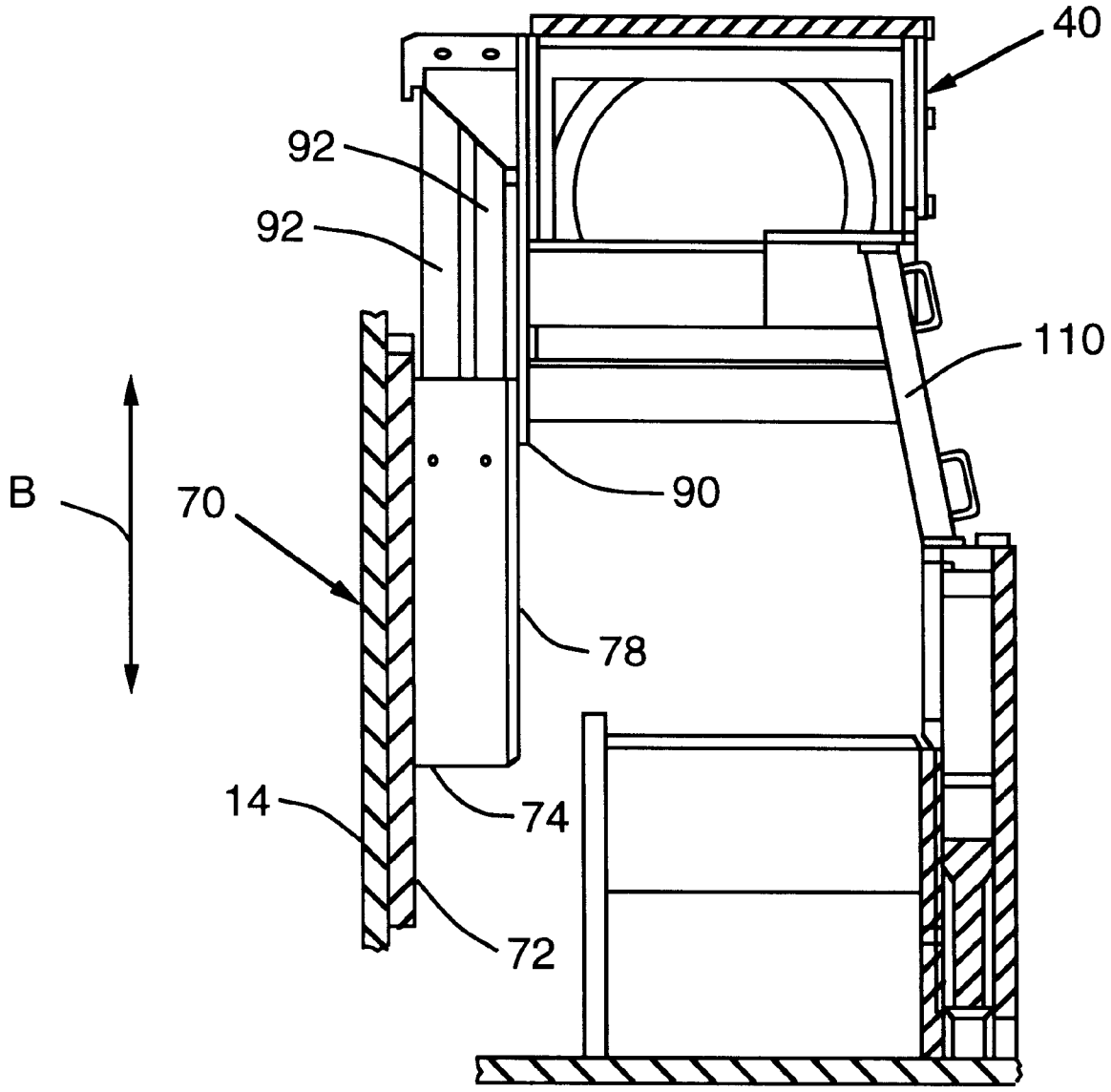
FIG. 8 is a partial cross-sectional view of the duct assembly and slidable support member of the present invention with a portion of the mining machine omitted for clarity and the duct assembly moved to a second position and a prop member inserted between the duct assembly and a portion of the mining machine frame.
Figure 9:
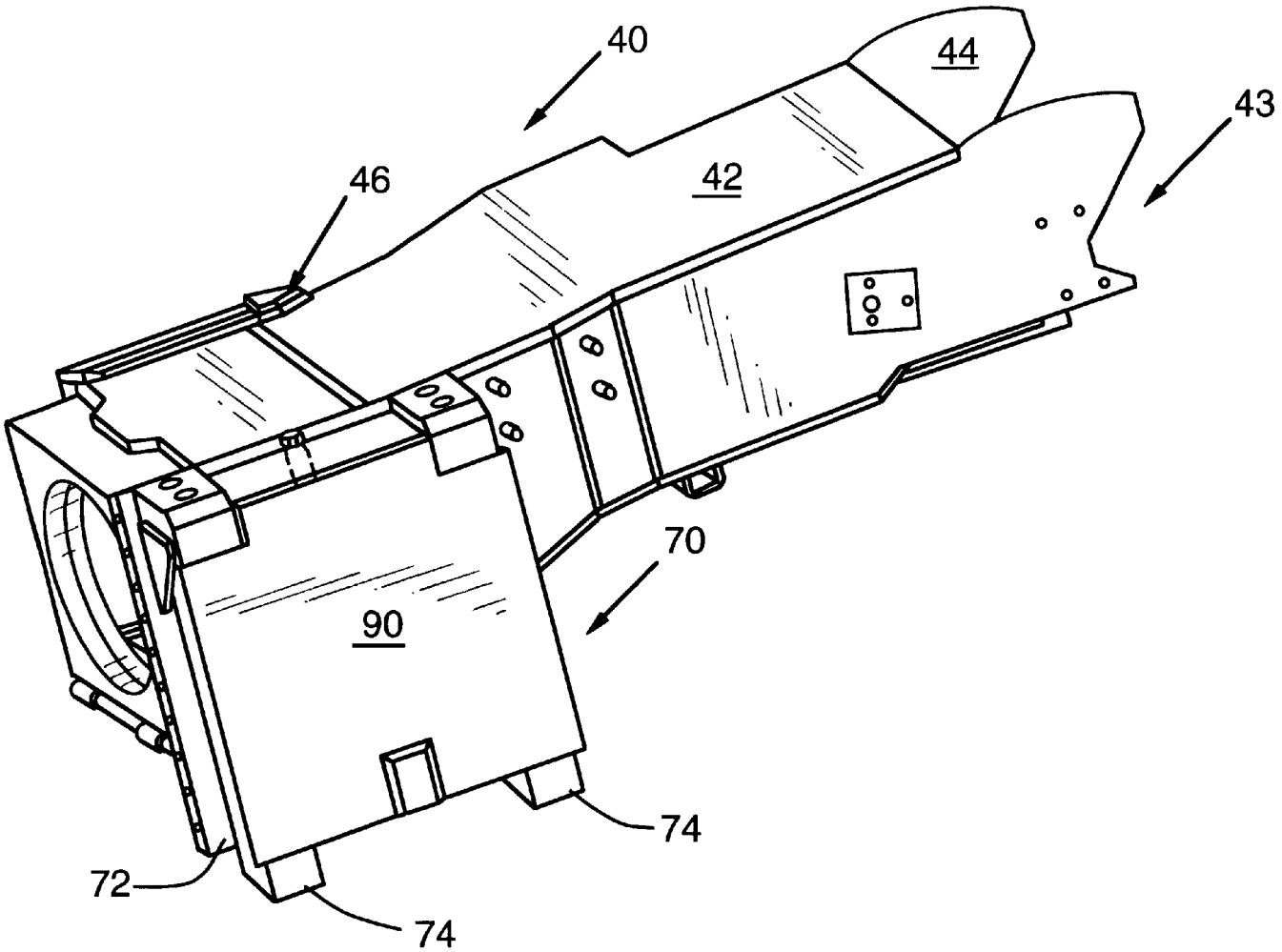
FIG. 9 is another perspective view of the duct assembly and slidable support member of the present invention with the duct assembly in the first position.

The hydraulic system for controlling the cylinder 100 is preferably configured as described above. The reader will appreciate that such system enables the piston 104 to be selectively extended between a first retracted position to a fully extended position and hydraulically retained in that position. However, to further ensure that the duct assembly does not inadvertently slide back toward the frame member 14 when performing maintenance work on the components 15, a rigid brace member 110 is preferably propped between the duct assembly and a portion of the frame 14 as shown in FIG. 8. As used herein with respect to the position of the duct assembly 40 or other displaceable duct assembly of other embodiments disclosed herein when in a second or maintenance position, "displaced from" refers to a position sufficiently spaced apart from the mining machine or support frame to which the duct assembly is attached to permit access to the portion or portions of the support frame or various other components attached thereto that are normally inaccessible when the displaceable duct assembly is in a first or filtering position.

The above-described embodiment of the present invention is operated as follows. When the duct assembly 40 is in the first or filtering position (FIGS. 1 and 3), the forward duct 42 is positioned such that the cover member 39 may be pivoted over the open end of the forward duct 42 to form a substantially enclosed passage 45 through which dust laden air may pass from the collection duct 30 to the duct assembly 40. Thus, when the fan 50 is powered, airflow is induced within the continuous passage 60 to draw dust laden air therein and through the filter assembly 46. The filtered air is then discharged through the end of the fan 50. When it is desired to access the portion of the frame 14 or the various components 15 attached thereto located under duct assembly 40 and/or fan 50, which could comprise, for example, hydraulic hoses or other hydraulic components that are inaccessible when duct assembly 40 and fan 50 are in a first position, the cover 39 is pivoted out of engagement with the forward portion of the duct. Thereafter, the cylinder 100 is actuated to extend piston 104. By extending piston 104, the duct assembly 40 and fan 50 are moved in a linear path to the second position. To ensure that the duct assembly 40 remains in that second position while the various components located thereunder are accessed, the support prop 110 is placed between the duct assembly 40 and a portion of frame 14 to mechanically retain the duct assembly 40 in that position. See FIG. 8. After the necessary maintenance or repair activities have been performed, the prop 110 is removed and preferably stored on the mining machine 12 for future use. Thereafter, the piston 104 is retracted. After the duct assembly 40 has been returned to the first position by cylinder 100, the cover plate 39 is pivoted over the forward portion of the duct and the filtering operation may again be commenced by activating fan 50.

Figure 11:
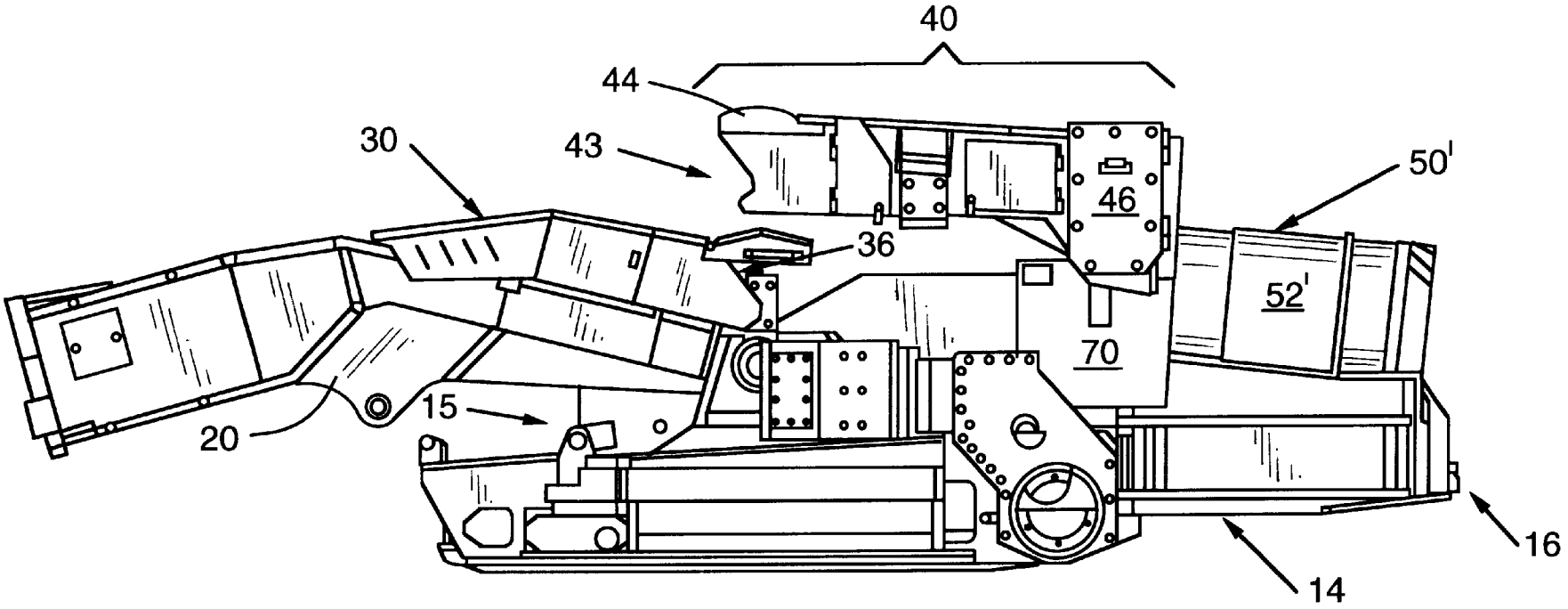
FIG. 11 is side elevational view of a mining machine with another displaceable duct assembly of the present invention in a second position.

Another embodiment is depicted in FIG. 11. In this embodiment, a fan 50' is attached to the frame 14 and is not slidably displaceable with the duct assembly 40. Thus, prior to displacing the duct assembly 40 to a second position, the suction end of the fan housing 52' must be detached from the filter assembly 46.

Although the mining machine disclosed herein is depicted with only one slidably displaceable duct assembly of the present invention, the skilled artisan will appreciate that multiple slidably displaceable duct arrangements could be successfully employed on a single mining machine depending upon its size. For example, a mining machine may be equipped with a left and right slidably displaceable duct assemblies that are each equipped with its own filtering system and fan. Those of ordinary skill in the art will appreciate that the unique and novel design of the present invention also makes it particularly well-suited for applications where ceiling height is limited because the duct assembly does not pivot in an arcuate path above the mining machine frame. Another distinct advantage over the prior duct arrangements is that the duct assembly is support throughout its range of travel when being moved between first and second positions. It will also be appreciated that, although the subject invention has been herein described as providing the ability to slidably displace the duct assembly away from the frame member along a linear path that is substantially perpendicular to the top of the frame member, other path configurations could also be employed. Furthermore, the slidable support arrangement of the present invention could also be conceivably arranged to slidably displace the filter assembly away from a corresponding side or rear portion of the mining machine frame.

Accordingly, the present invention provides solutions to the aforementioned problems commonly encountered with mining machine ductwork. The skilled artisan will appreciate that the present invention provides quick and efficient access to components typically located under such heavy and cumbersome ductwork. It will be further appreciated that the various unique aspects of the present invention can be incorporated and successfully used in a variety of other filtering applications. It will therefore be understood that various changes in the details, materials and arrangements of parts which have been herein described and illustrated in order to explain the nature of the invention may be made by those skilled in the art within the principle and scope of the invention as expressed in the appended claims.

What is claimed is:

1. Apparatus for filtering airborne contaminates, comprising:

a frame member;

a collection duct attached to said frame member;

a duct assembly slidably supported on said frame member for movement between a first position adjacent said frame member and said collection duct such that said duct assembly cooperates with said collection duct to create an air flow passage therebetween and a second position wherein said duct assembly is displaced from said frame member;

a fan attached to said duct assembly for travel therewith;

a support attached to said frame member and said duct assembly for slidably supporting said duct assembly relative to said frame member along a linear path between said first and second positions;

a displacement member for selectively displacing said duct assembly between said first and second positions along said linear path, at least one slide rod attached to said duct assembly; and a housing attached to said frame member, said housing having an elongated passage therein corresponding to each said slide rod to slidably receive said corresponding slide rod therein, said housing further comprising an elongated member having at least one primary external slide surface formed thereon, and wherein said duct assembly has a secondary elongated slide surface formed thereon corresponding to each said primary external slide surface for slidable engagement therewith as said duct assembly is slidably displaced between said first and second positions.

2. The apparatus of claim 1 wherein said displacement member comprises at least one hydraulically-actuated cylinder attached between said frame member and said duct assembly.

3. The apparatus of claim 1 further comprising a support prop sized to extend between said duct assembly and said frame member when said duct assembly is in said second position to prevent said duct assembly from slidably advancing toward said frame member.

4. The apparatus of claim 1 further comprising a filter mounted within said duct assembly.

5. The apparatus of claim 4 wherein said filter comprises a fluid scrubber assembly.

6. The apparatus of claim 1 wherein said apparatus further comprises a support cradle attached to said frame member for receiving an end of a housing supporting said fan when said duct assembly is in said first position.

7. Apparatus for collecting airborne contaminates generated by a mining head of a mining machine having a top portion, comprising:

a collection duct attached to the mining machine adjacent the mining head;

a duct assembly removably connected to said collection duct for creating an air flow passage and supported on said top portion of said mining machine;

a filter assembly mounted within said duct assembly to filter contaminates from an air flow passing through said duct assembly;

a fan attached to said duct assembly for inducing an airflow therein;

a support attached to said mining machine and said duct assembly, said support defining a linear track forslidably supporting said duct assembly relative to said mining machine between a first position wherein said duct assembly is attached to said collection duct and a second position spaced-apart from said top portion of said mining machine;

a hydraulic cylinder attached two said mining machine and said duct assembly for selectively moving said duct assembly between said first and second positions; and a cradle attached to said mining machine for supporting said fan member when said duct assembly is in said first position.

8. A mining machine, comprising:

a frame member;

tractive means attached to said frame for propelling said frame member on a surface;

a mining assembly operably attached to said frame member and constructed to dislodge a material from a seam when brought into contact therewith;

a collection duct attached to said frame member adjacent said mining assembly for collecting airborne contaminates generated when said mining assembly contacts said seam;

a duct assembly removably attachable to said collection duct when said duct assembly is adjacent to said frame member in a first position;

a filter within said duct assembly for filtering airborne contaminates passing therethrough;

a fan attached to said duct assembly for travel therewith;

a first support member attached to said frame member and said cut assembly, said first support member defining a linear track for slidably supporting said duct assembly between said first position and a second position spaced apart from said frame member;

a displacement member attached to said frame member and said duct assembly for selectively displacing said duct assembly between said first and second positions;

a second support member attached to said frame member for supporting said fan when said duct assembly is in said first position.

9. A method for filtering airborne dust created by a mining machine during mining, said method comprising:

attaching a collection duct to said mining machine for collecting said airborne dust therein;

slidably supporting a duct assembly that includes a filter and a fan on a frame of said mining machine for slidable travel along a linear path between a first position adjacent said mining machine frame and said collection duct and a second position spaced apart from said mining machine frame;

attaching an end of said duct assembly to said collection duct;

activating said fan to draw said airborne dust through said collection duct, said duct assembly and said filter.

10. The method of claim 9 further comprising:

deactivating said fan; and accessing components located between said mining machine frame and said duct assembly.

11. The method of claim 10 wherein said accessing comprises:

detaching said duct assembly and said collection duct;

displacing said duct assembly along said linear path from said first position to said second position; and retaining said duct assembly in said second position to permit access to said components.

12. The method of claim 11 wherein said retaining comprises inserting a prop member between said duct assembly and said frame to prevent said duct assembly from moving toward said frame member.

13. The method of claim 11 further comprising:

returning said duct assembly to said first position;

reattaching said duct assembly to said collection duct; and reactivating said fan to recommence the filtering of said airborne dust passing through said duct assembly.

* * * * *